US006344833B1

(12) United States Patent
Lin et al.

(10) Patent No.: US 6,344,833 B1
(45) Date of Patent: Feb. 5, 2002

(54) ADJUSTED DIRECTIVITY DIELECTRIC RESONATOR ANTENNA

(75) Inventors: Yi-Cheng Lin, San Diego; Mohammad A. Tassoudji, Cardiff, both of CA (US)

(73) Assignee: Qualcomm Inc., San Diego, CA (US)

( * ) Notice: Subject to any disclaimer, the term of this patent is extended or adjusted under 35 U.S.C. 154(b) by 0 days.

(21) Appl. No.: 09/539,845

(22) Filed: Mar. 31, 2000

Related U.S. Application Data

(60) Provisional application No. 60/127,491, filed on Apr. 2, 1999.

(51) Int. Cl.[7] ..... H01Q 1/36

(52) U.S. Cl. ..... 343/846; 343/785; 343/873

(58) Field of Search ..... 343/785, 700 MS, 343/872, 873, 846, 830; H01Q 1/38, 1/36

(56) References Cited

U.S. PATENT DOCUMENTS

| | | | | |
|---|---|---|---|---|
| 4,125,837 | A | 11/1978 | Kaloi | 343/700 |
| 4,125,838 | A | 11/1978 | Kaloi | 343/700 |
| 4,125,839 | A | 11/1978 | Kaloi | 343/700 |
| 4,162,499 | A | 7/1979 | Jones, Jr. et al. | 343/700 |
| 4,218,682 | A | 8/1980 | Yu | 343/700 |
| 4,329,689 | A | 5/1982 | Yee | 343/700 |
| 4,692,769 | A | 9/1987 | Gegan | 343/700 |
| 5,396,202 | A | 3/1995 | Scheck | 333/230 |
| 5,453,754 | A | 9/1995 | Fray | 343/789 |
| 5,557,293 | A | 9/1996 | McCoy et al. | 343/867 |
| 5,748,154 | A | 5/1998 | Yokota | 343/702 |
| 5,940,036 | A | 8/1999 | Oliver et al. | 343/700 |
| 5,952,972 | A | 9/1999 | Ittipiboon et al. | 343/700 |

FOREIGN PATENT DOCUMENTS

| | | | |
|---|---|---|---|
| EP | 0372451 | 6/1990 | H01Q/5/00 |
| EP | 0747990 | 12/1996 | H01Q/1/24 |
| JP | 04134906 | 5/1992 | H01Q/5/00 |
| JP | 10126134 | 5/1998 | H01Q/1/38 |

OTHER PUBLICATIONS

Drossos G. et al.; Switchable Cylindrical Dielectric Resonator Antenna; Electronics Letters; May 9, 1996; vol. 32; No. 10 pp. 862–864.

Haneishi et al.; "Broadband Circularly Polarized Planar Array composed of a pair of Dielectric Resonator Antenna"; May 9, 1985, vol. 21, No. 10, pp. 437–438.

Kishk, A. A. et al.; Broadband Stacked Dielectric Resonator Antennas; Electronics Letters; Aug. 31, 1989; vol. 25; No. 18; pp. 1232–1233.

Martin et al., "Dielectric Resonator Antenna Using Aperture Coupling," Electronic Letters, Nov. 22, 1990, vol. 26, No. 24, pp. 2015–2016.

Mongia, R. K. et al.; Circularly Polarised Dielectric Resonator Antenna; Electric Letters; Aug. 18, 1994; vol. 30; No. 17; pp. 1361–1362.

Patent Abstracts of Japan vol. 016, No. 403 (E–1254), Aug. 26, 1992 & JP 04 134906 A (Nippon Telegr & Teleph), May 8, 1992 Abstract; Figure 8.

*Primary Examiner*—Michael C. Wimer
(74) *Attorney, Agent, or Firm*—Philip R. Wadsworth; Gregory D. Ogrod

(57) ABSTRACT

A dielectric resonator antenna having a resonator formed from a dielectric material mounted on a ground plane with a conductive skirt. The ground plane is formed from a conductive material. First and second probes are electrically coupled to the resonator for providing first and second signals, respectively, to or receiving from the resonator. The first and second probes are spaced apart from each other. The first and second probes are formed of conductive strips that are electrically connected to the perimeter of the resonator and are substantially orthogonal with respect to the ground plane. A dual band antenna can be constructed by positioning and connecting two dielectric resonator antennas together. Each resonator in the dual band configuration resonates at a particular frequency, thereby providing dual band operation. The resonators can be positioned either side by side or vertically. Further advantage is obtained by mounting the dual antenna stack within a radome.

50 Claims, 12 Drawing Sheets

VERTICAL RADIATION PATTERN

ANTENNA DIRECTIVITY (dBic) VS. ELEVATION ANGLE θ

| Dmax | Davg | Dmin |
|---|---|---|
| 5.5477 | 2.7504 | -1.2703 |

AZIMITHAL RADIATION PATTERN

| Dmax | Davg | Dmin |
|---|---|---|
| -0.9192 | -1.1445 | -1.5017 |

ADJUSTED DIRECTIVITY DIELECTRIC RESONATOR ANTENNA

This application claims benefit of Prov. No. 60/127,491 filed Apr. 2, 1999.

BACKGROUND OF THE INVENTION

I. Field of the Invention

The present invention relates generally to antennas for wireless devices. More specifically, the present invention relates to a stacked dielectric resonator antenna assembly that uses a conductive skirt in contact with the ground plane to adjust the directivity of the antenna radiation patterns. Furthermore, the present invention relates to a low profile dielectric resonator antenna assembly for use with satellite or wireless communication systems.

II. Description of the Related Art

Recent advances in wireless communication devices, such as mobile and fixed phones for use in satellite or cellular communications systems, have motivated efforts to design antennas more suitable for use with such devices. New antennas are generally needed to meet design constraints being imposed on new devices including overall size, profile, weight, and manufacturability. Several factors are usually considered in selecting an antenna design for a wireless device or phone, such as the size, the bandwidth, and the radiation pattern of the antenna.

The radiation pattern of an antenna is a very significant factor to be considered in selecting an antenna. In a typical application, a user of a wireless device such as a mobile phone needs to be able to communicate with a satellite or a ground station that can be located in a variety of directions relative to the user. Consequently, an antenna connected to the wireless device should preferably be able to transfer, transmit and/or receive, signals from may directions. That is, the antenna should preferably exhibit an omni-directional radiation pattern in azimuth and a wide beamwidth (preferably hemispherical) in elevation.

Another factor that must be considered in selecting an antenna for a wireless device is the antenna bandwidth. That is, the useful range of frequencies over which the antenna efficiently transfers signals without an undesirable amount of loss. As an example, a typical wireless phone transmits and receives signals at separate frequencies. For example, a Personal Communication Services or PCS type phone operates over a frequency band of 1.85–1.99 GHz, requiring a bandwidth of 7.29%. A typical cellular phone operates over a frequency band of 824–894 MHz which requires an 8.14% bandwidth. Some satellite communication systems may have even wider bandwidth requirements. Accordingly, antennas for wireless phones used in such systems must be designed to meet these larger bandwidths.

Currently, monopole antennas, patch antennas, and helical antennas are among the various types of antennas being used in satellite user terminals or phones and other wireless-type devices. These antennas, however, have several disadvantages, such as limited bandwidth and large size. These antennas also exhibit a significant reduction in gain at lower elevation angles (for example, around 10 degrees), which makes them undesirable for use in satellite phones where a given satellite used for communication may frequently be near this low elevation.

An antenna that appears attractive for use in wireless user terminals or phones is the dielectric resonator antenna. Generally, dielectric resonators are fabricated from low loss materials that have high permittivity. Until recently, dielectric resonator elements have only found use in microwave circuits, such as in filters and oscillators. However, dielectric resonator antennas have been proposed and designed for wireless applications as described in U.S. patent application Ser. No. 09/150,157 entitled "Circularly Polarized Dielectric Resonator Antenna" filed Sep. 9, 1998, now U.S. Pat. No. 6,147,647 assigned to the same assignee, and incorporated herein by reference.

Dielectric resonator antennas offer several advantages over other antennas, such as small size, high radiation efficiency, and simplified coupling schemes for various transmission lines. The bandwidth can be controlled over a wide range by the choice of dielectric constant ($\in_r$), and the geometric parameters of the resonator. Such antennas can also be made in low profile configurations, making them more aesthetically pleasing than standard whip, helical, or other upright antennas. A low profile antenna is also less subject to damage than other upright style antennas. Therefore, dielectric resonator antennas appear to have significant potential for use, for example, in mobile or fixed wireless phones for satellite or cellular communications systems.

However, one problem encountered in using current dielectric resonator antenna designs is the requirement for multiple signal leads to achieve desired circularly polarized radiation patterns. That is, not unlike some patch antennas, two signal feeds are required which are separated in position by what is termed 90 degrees of phase. The ability to handle circularly polarized radiation is critical to applications such as Low Earth Orbit (LEO) satellite communication systems. Generally, the two signal feeds are positioned on the perimeter of the dielectric material. The requirement for two very low loss cables, that need to be substantially identical or matched in impedance to prevent an unbalanced feed structure places undesired restrictions on antenna placement and design.

Not only is circularly polarized radiation employed in some communication systems, but two antennas are often used, one for transmitting and one for receiving. In addition, there are plans to use multiple receiving and transmitting antennas to mitigate the affects of specular reflection, or arrays to create specially tailored radiation patterns that provide improved gain for horizon-to-horizon coverage or multiple satellite communications. In any case, it is very inconvenient and sometimes impractical to manufacture antenna assemblies with multiple antennas having two or more signal leads per antenna element, along with associated cables, connectors, and matching circuits. Each item or component, including cables, added to multiple antenna structures consumes room, making the structure undesirably larger, and makes it more difficult to physically assemble. It is also evident that the more components involved in any assembly make it more costly to manufacture, and may decrease operational reproducibility and reliability.

What is needed is an antenna structure that can maintain a desired polarization configuration, provide efficiently tailored radiation patterns, while allowing simplified signal transfer, impedance matching, and manufacturing or assembly.

SUMMARY OF THE INVENTION

The present invention is directed to a dielectric resonator antenna having a ground plane formed of a conductive material, and a resonator formed from a dielectric material mounted on the ground plane. The ground plane extends beyond the edge or periphery of the resonator is shaped so that it extends downward from a lower portion of the resonator material, forming a conductive skirt about a main or central portion of the ground plane. A ground plane is typically formed as a conductive layer of material on top of a support substrate such as a multi-layered printed circuit board material.

At least one, and generally two signal probes are electrically coupled to the resonator to provide first and second signals, respectively, to the resonator, and produce circularly polarized radiation in the antenna. Preferably, the resonator is substantially cylindrical, although rectangular, elliptical shapes or other shapes may be used as desired. The dielectric material may have a central axial opening therethrough. Also preferably, the first and second probes are spaced approximately 90 degrees apart around the perimeter of the resonator.

In a further embodiment, the invention is directed to a dual band dielectric resonator antenna, having a first dielectric resonator mounted on a first ground plane formed of a conductive material, and a second resonator mounted on a second ground plane formed of a conductive material. The first and second ground planes are separated from each other by a predetermined distance, and each has an outer portion that extends downward. First and second probes are electrically coupled to each of the resonators and are spaced approximately 90 degrees apart around the perimeter of each resonator to provide first and second signals, respectively, to each resonator. Each of the resonators resonates in a predetermined frequency band that differs between the resonators. Support members mount the first and second ground planes in spaced apart relation with a predetermined separation distance such that the central axes of the resonators are substantially aligned with each other.

In a still further embodiment, the invention is directed to a multi-band antenna assembly in which first and second dielectric resonators are each mounted on a central portion of a ground plane formed of conductive material. The first and second ground plane central portions are mounted inside a radome separated from each other by a predetermined distance. An outer edge of each ground plane main portion makes contact with a conductive skirt formed on an interior wall of said radome adjacent to where each is mounted. Each ground plane central portion is electrically connected to a corresponding conductive skirt.

In further embodiments, the skirts are each deposited on the radome inner wall by plating. The radome has two rims formed on said inner surface, one located where each ground plane central portion is to be mounted, and for supporting said ground plane. Each ground plane is connected to a corresponding skirt by physical contact therewith, or by using electrically conductive material disposed on or contacting said ground plane and skirt.

BRIEF DESCRIPTION OF THE DRAWINGS

Further features and advantages of the invention, as well as the structure and operation of various embodiments of the invention, are described in detail below with reference to the accompanying drawings. In the drawings, like reference numbers generally indicate identical, functionally similar, and/or structurally similar elements, and the drawing in which an element first appears is indicated by the leftmost digit(s) in the reference number.

DETAILED DESCRIPTION OF THE PREFERRED EMBODIMENTS

I. Dielectric Resonators

Figure 1A:
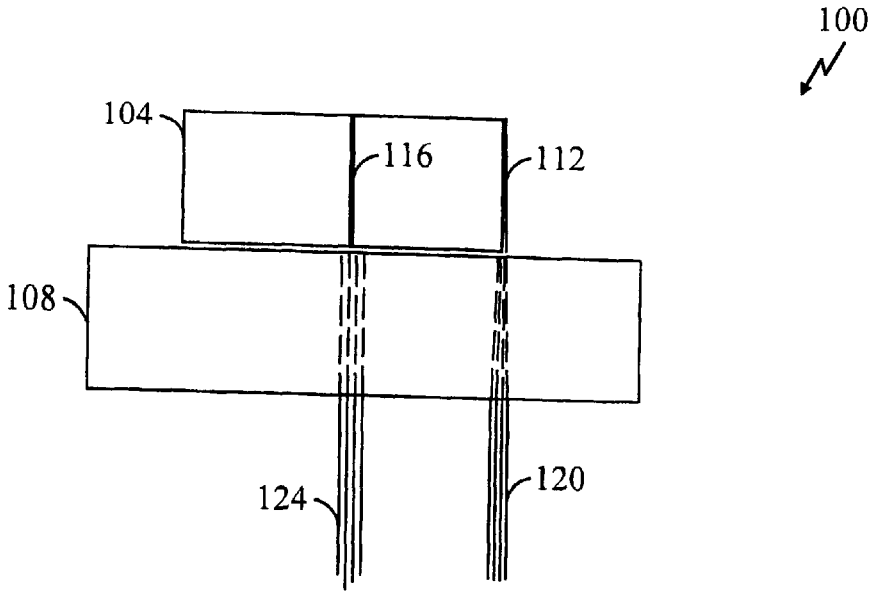
FIGS. 1A and 1B illustrate side and top views, respectively, of a cylindrical dielectric resonator antenna constructed and operating in accordance with one embodiment of the present invention.

Dielectric resonators offer attractive features as antenna elements. These features include their small size, mechanical simplicity, high radiation efficiency because there is no inherent conductor loss, relatively large bandwidth, ability to implement simple coupling schemes for a variety of commonly used transmission lines, and the advantage of obtaining different radiation characteristics using different modes of the resonator.

The size of a dielectric resonator is inversely proportional to the square root of $\in$hd r, where $\in_r$ is the dielectric constant of the resonator. As a result, as the dielectric constant $\in_r$ increases, the size of the dielectric resonator decreases. Consequently, by choosing a high value of $\in_r$ (say $\in_r$=10–100), the size (especially the height) of the dielectric resonator antenna can be made quite small, as desired for many new wireless applications.

The bandwidth of the dielectric resonator antenna is inversely proportional to $(\in_r)^{-p}$, where the value of p (p>1) depends upon the mode being used. As a result, the bandwidth of the dielectric resonator antenna decreases with an increase in the dielectric constant. It must be noted, however, that the dielectric constant is not the only factor determining the bandwidth of a dielectric resonator antenna. The other factors affecting the bandwidth of the dielectric resonator are its shape and dimensions (height, length, diameter, etc.), as would be known.

One advantage for a dielectric resonator antennas is a lack of inherent conductor loss. This low loss leads to high radiation efficiency of the antenna.

The resonant frequency of a dielectric resonator antenna can be determined by computing the value of normalized wavenumber $k_0a$. The wavenumber $k_0a$ is given by the relationship $k_0a=2\pi f_0/c$, where $f_0$ is the resonant frequency, a is the radius of the cylinder, and c is the velocity of light in free space. However, if the value of $\in_r$ is very high, ($\in_r>100$), the value of the normalized wavenumber varies with $\in_r$, according to the relationship:

$$k_0a \propto \frac{1}{\sqrt{\epsilon_r}}, \tag{1}$$

for a given aspect ratio of a dielectric resonator.

For high values of $\in_r$, the value of the normalized wavenumber as a function of the aspect ratio (height(H)/2*radius(a)) can be determined for a single value of $\in_r$. However, if the $\in_r$ of the material used is not very high, the relationship shown in equation. (1) does not hold exactly. If the value of $\in_r$ is not very high, computations are required for each different value of $\in_r$. By comparing results from numerical methods available for different values of $\in_r$, it has been found that the following empirical relationship can be used as a good approximation to describe the dependence of the normalized wavenumber as a function of $\in_r$:

$$k_0a \propto \frac{1}{\sqrt{\epsilon_r X}}, \tag{2}$$

wherein the value of X is found empirically from the results of the numerical methods.

The impedance bandwidth of a dielectric resonator antenna is defined as the frequency bandwidth in which the input Voltage Standing Wave Ratio (VSWR) of the antenna is less than a specified value S. VSWR is a function of an incident wave and a reflected wave in a transmission line, and it is a well known terminology used in the art. The impedance bandwidth ($BW_i$) of an antenna, which is matched to a transmission line at its resonant frequency, is related to the total unloaded Q-factor ($Q_u$) of a dielectric resonator by the relationship:

$$BW_i = \frac{S-1}{Q_u\sqrt{S}} \tag{3}$$

Note that Q is proportional to the ratio of the energy stored to the energy lost in heat or radiation, and it is a well known terminology used in the art. For a dielectric resonator, which has a negligible conductor loss compared to its radiated power, the total unloaded Q-factor ($Q_u$) is related to the radiation Q-factor ($Q_{rad}$) by the relation:

$$Q_u \approx Q_{rad} \tag{4}$$

Numerical methods are required to compute the value of the radiation Q-factor of a dielectric resonator. For a given mode, the value of the radiation Q-factor depends on the aspect ratio and the dielectric constant of a resonator. It has been shown that for resonators of very high permittivity, $Q_{rad}$ varies with $\in_r$ as $$Q_{rad}\ \alpha(\in_r)^p, \tag{5}$$

where the permittivity (p)=1.5, for modes that radiate like a magnetic dipole; p=2.5, for modes that radiate like an electric dipole; and p=2.5, for modes that radiate like a magnetic quadrupole.

II. Dielectric Resonator Antenna

Figure 1B:
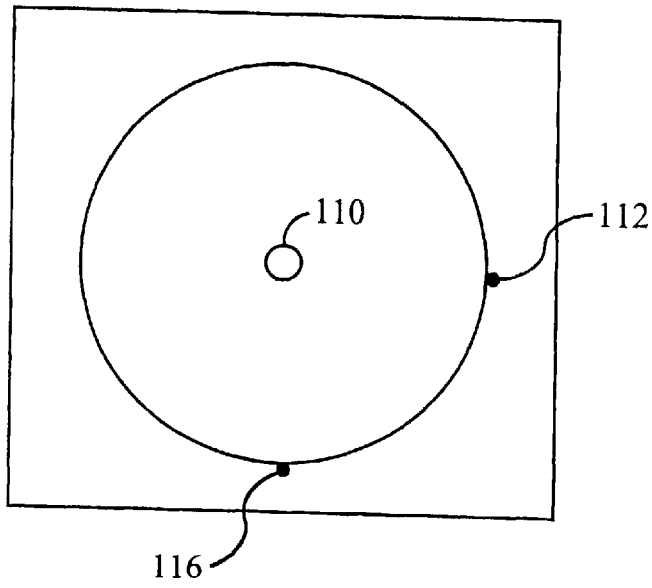

Using the above and known principles of antenna designing a dielectric resonator antenna can be constructed as disclosed in U.S. patent application Ser. No. 09/150,157, discussed above. FIGS. 1A and 1B illustrate a side view and a top view, respectively, of a dielectric resonator antenna 100. Dielectric resonator antenna 100 includes a resonator 104 formed from a dielectric material mounted on a ground plane 108 formed from a conductive material. In FIG. 1, resonator 104 is shown having a cylindrical shape. First and second probes or conductive leads 112 and 116, respectively, are electrically connected to the dielectric resonator. The first and second probes provide the dielectric resonator with two signals that have substantially equal magnitudes, but are 90° out of phase with respect to each other.

Resonator 104 is tightly mounted on ground plane 108. In one embodiment, resonator 104 is attached to ground plane 108 by means of an adhesive, preferably an adhesive having conductive properties. Alternatively, resonator 104 may be attached to ground plane 108 by a screw, bolt or other known fastener (shown in FIG. 2B) extending through an opening 110 along the center axis of resonator 104 for the modes that radiate like a magnetic dipole and into ground plane 108. Since a null exists at the center axis of resonator 104, the fastener will not interfere with the radiation pattern of antenna 100 in any substantial manner.

In order to prevent a degradation of the performance of the dielectric resonator antenna, including bandwidth and radiation pattern, it is necessary to minimize any gap or separation between resonator 104 and ground plane 108. This is preferably achieved by tightly mounting resonator 104 on ground plane 108. Alternatively, a gap between resonator 104 and ground plane 108 can by filled by a pliable or a malleable conductive material. If resonator 104 is loosely mounted on ground plane 108, there may remain an unacceptable amount of separation between the resonator and the ground plane, which can degrade the performance of the antenna by distorting the VSWR, resonant frequency, and radiation pattern.

Feed probes 112 and 116 are electrically connected to resonator 104 through passages in ground plane 108. Generally, feed probes (shown in FIG. 2A) are formed using a metal strip axially aligned with and connected to the perimeter of resonator 104. Feed probes may comprise extensions of the inner conductors of coaxial cables 120 for example, the outer conductor of which may be electrically connected to ground plane 108. Coaxial cable 120 may be connected to radio transmit and receive circuits (not shown) in a known manner.

Feed probes 112 and 116 are positioned substantially orthogonal to ground plane 108, and provide signals to resonator 104. The first and second signals have substantially equal amplitude, but are formed to be out of phase with respect to each other by 90 degrees. When resonator 104 is fed by two signals having equal magnitude, but which are out of phase with respect to each other by 90 degrees, two magnetic dipoles that are substantially orthogonal to each other are produced above the ground plane. The orthogonal magnetic dipoles produce a circularly polarized radiation pattern.

In one embodiment, resonator 104 is formed from a ceramic material, such as barium titanate, which has a high dielectric constant $\in$. As noted before, the size of the resonator is inversely proportional to $\sqrt{\in_r}$. Therefore, by choosing a high value of $\in_r$, resonator 104 may be made relatively small. However, other dielectric materials having similar properties can also be used, and other sizes are allowed depending on the design constraints and desired features for specific applications.

Antenna 100 has a significantly lower height than say a quadrafilar helix antenna operating at the same frequency band. For example, a dielectric resonator antenna operating at S-band frequencies has a significantly lower height than a quadrafilar helix antenna also operating at S-band frequencies. This lower height makes a dielectric resonator antenna more desirable in many wireless phone applications, especially for fixed terminal use.

Tables I and II below compare the dimensions (height and diameter) of a dielectric resonator antenna with a typical quadrafilar helix antenna operating at L-band frequencies (1–2 GHz range) and S-band frequencies 2–4 GHz range), respectively.

TABLE I

| Antenna type | Height | Diameter |
|---|---|---|
| Dielectric resonator antenna (S-band) | 0.28 inches | 2.26 inches |
| Quadrafilar helix antenna (S-band) | 2.0 inches | 0.5 inches |

TABLE II

| Antenna type | Height | Diameter |
|---|---|---|
| Dielectric resonator antenna (L-band) | 0.42 inches | 3.38 inches |
| Quadrafilar helix antenna (L-band) | 3.0 inches | 0.5 inches |

Tables I and II show that, although a dielectric resonator antenna has a smaller height than a quadrifilar helix antenna operating at the same frequency band, a dielectric resonator antenna has a larger diameter than a quadrifilar helix antenna. In other words, the advantage gained by the reduction in height of a dielectric resonator antenna might appear to be offset by a larger diameter in some applications. In reality, a larger diameter is not of a great concern in most applications, because the primary goal of this antenna design is to obtain a low profile. A dielectric resonator antenna of this type could be built into a car roof without significantly altering the roof line. Similarly, an antenna of this type could be mounted on a remotely located fixed phone booth of a wireless satellite telephone communication system.

Furthermore, antenna 100 provides significantly lower loss than a comparable quadrifilar helix. This is due to the fact that there is no conductor loss in dielectric resonators, thereby leading to high radiation efficiency. As a result, antenna 100 requires a lower power transmit amplifier to achieve the same power output, and a lower noise figure receiver than would be required for a comparable quadrifilar helix antenna.

Reflected signals from ground plane 108 can destructively add to the radiated signals from resonator 104. This is often referred to as destructive interference, which has the undesirable effect of distorting the radiation pattern of antenna 100. In one embodiment, the destructive interference is reduced by forming a plurality of slots in ground plane 108. These slots alter the phase of the reflected waves, thereby preventing reflected waves from destructively summing and distorting the radiation pattern of antenna 100.

The field around the edge of ground plane 108 also interferes with the radiation pattern of antenna 100. This interference can be reduced by serrating or otherwise forming discontinuities in the edge of ground plane 108. Serrating the edge of ground plane 108 reduces the coherency of the fields near the edge of ground plane 108, which reduces the distortion of the radiation pattern by making antenna 100 less susceptible to the surrounding fields.

In actual operation, two separate antennas are often desired for transmit and receive capabilities. For example, in a satellite telephone system, a transmitter may be configured to operate at L band frequencies and a receiver may be configured to operate at S band frequencies. In that case, an L band antenna may operate solely as a transmit antenna and an S band antenna may operate solely as a receive antenna. As is readily understood, other frequencies and signal transfer functions can be assigned to each antenna, as desired.

Figure 2A:
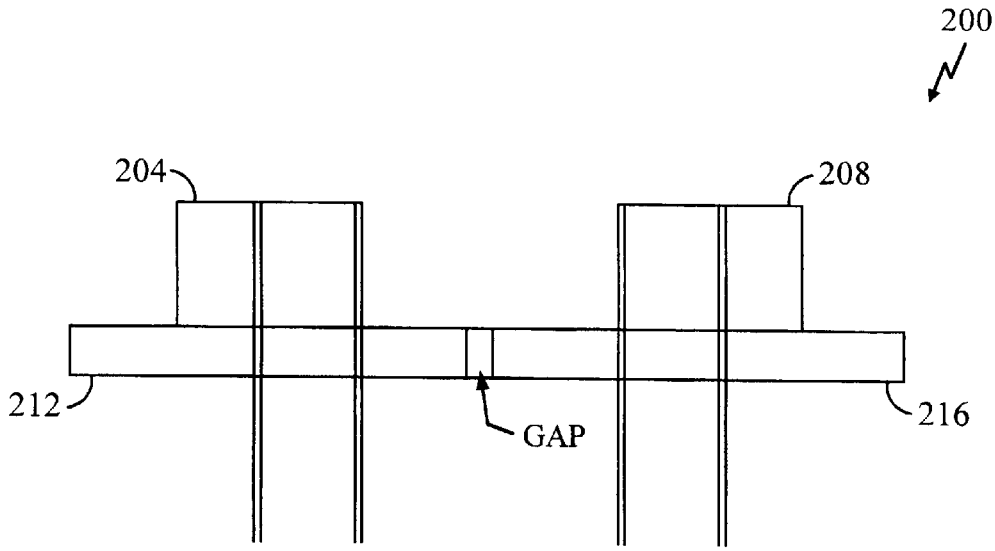
FIG. 2A illustrates an antenna assembly comprising two dielectric resonator antennas connected side-by-side.

FIG. 2A illustrates an antenna assembly 200 comprising two antennas 204 and 208. Antenna 204 is an L band antenna operating solely as a transmit antenna, while antenna 208 is an S band antenna operating solely as a receive antenna. Alternatively, the L band antenna can operate solely as a receive antenna, while the S band antenna can operate solely as a transmit antenna. Antennas 204 and 208 may have different diameters depending on their respective dielectric constants $\in_r$ and the frequencies of interest for which they are to be used.

Antennas 204 and 208 are connected together along ground planes 212 and 216. Since antenna 204 operates as a transmit antenna, the radiated signal from antenna 204 excites ground plane 216 of antenna 208. This causes undesirable electromagnetic coupling between antennas 204 and 208. The electromagnetic coupling can be minimized by selecting an optimum gap 218 between ground planes 212 and 216. The optimum width of gap 218 can be determined experimentally. Experimental results have shown that the electromagnetic coupling between antennas 204 and 208 increases if gap 218 is greater or less than the optimum gap spacing. The optimum gap spacing is a function of the operating frequencies of antennas 204 and 208 and the size of ground planes 212 and 216. For example, it has been determined that for an S-band antenna and an L-band antenna configured side-by-side as illustrated in FIG. 3A, the optimum gap spacing is 1 inch; that is, ground planes 212 and 216 should be separated by 1 inch for good performance.

Figure 2B:
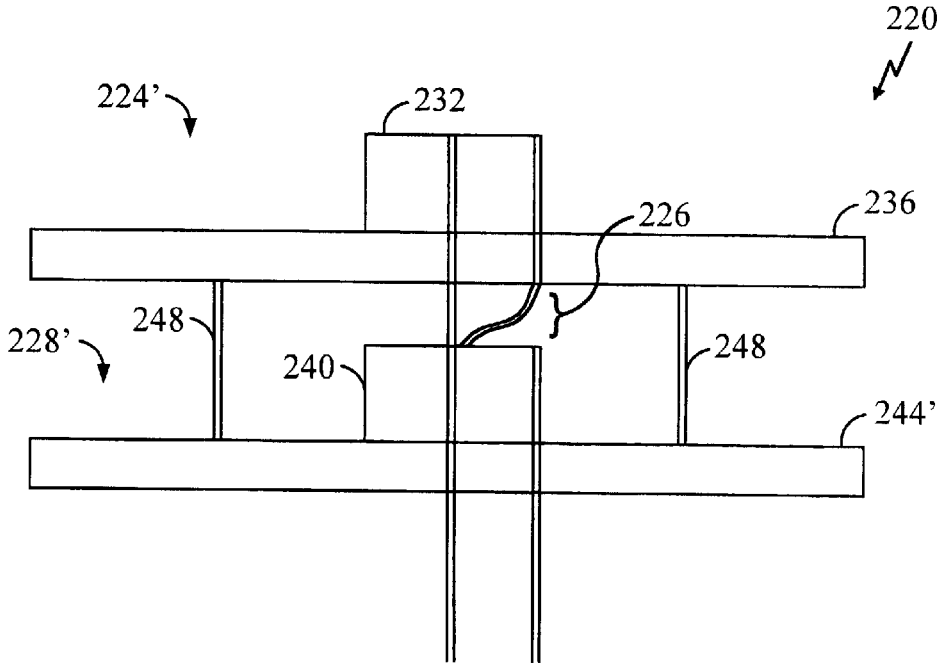
FIG. 2B illustrates an antenna assembly comprising two stacked dielectric resonator antennas connected vertically.

Alternatively, an S-band antenna and an L-band antenna can be stacked vertically. FIG. 2B shows an antenna assembly 220 comprising an S-band antenna 224 and an L-band antenna 228 stacked vertically along a common axis. Alternatively, antennas 224 and 228 may be stacked vertically, but not along a common axis, that is, they may have their central axes offset from each other. Antenna 224 comprises a dielectric resonator 232 and a ground plane 236, and antenna 228 comprises a dielectric resonator 240 and a ground plane 244. Ground plane 236 of antenna 224 is placed on top of dielectric resonator 240 of antenna 228. Non-conducting support members 248 fix antenna 224 in spaced relation to antenna 228 with a gap 226 between ground plane 236 and resonator 240.

Figure 2C:
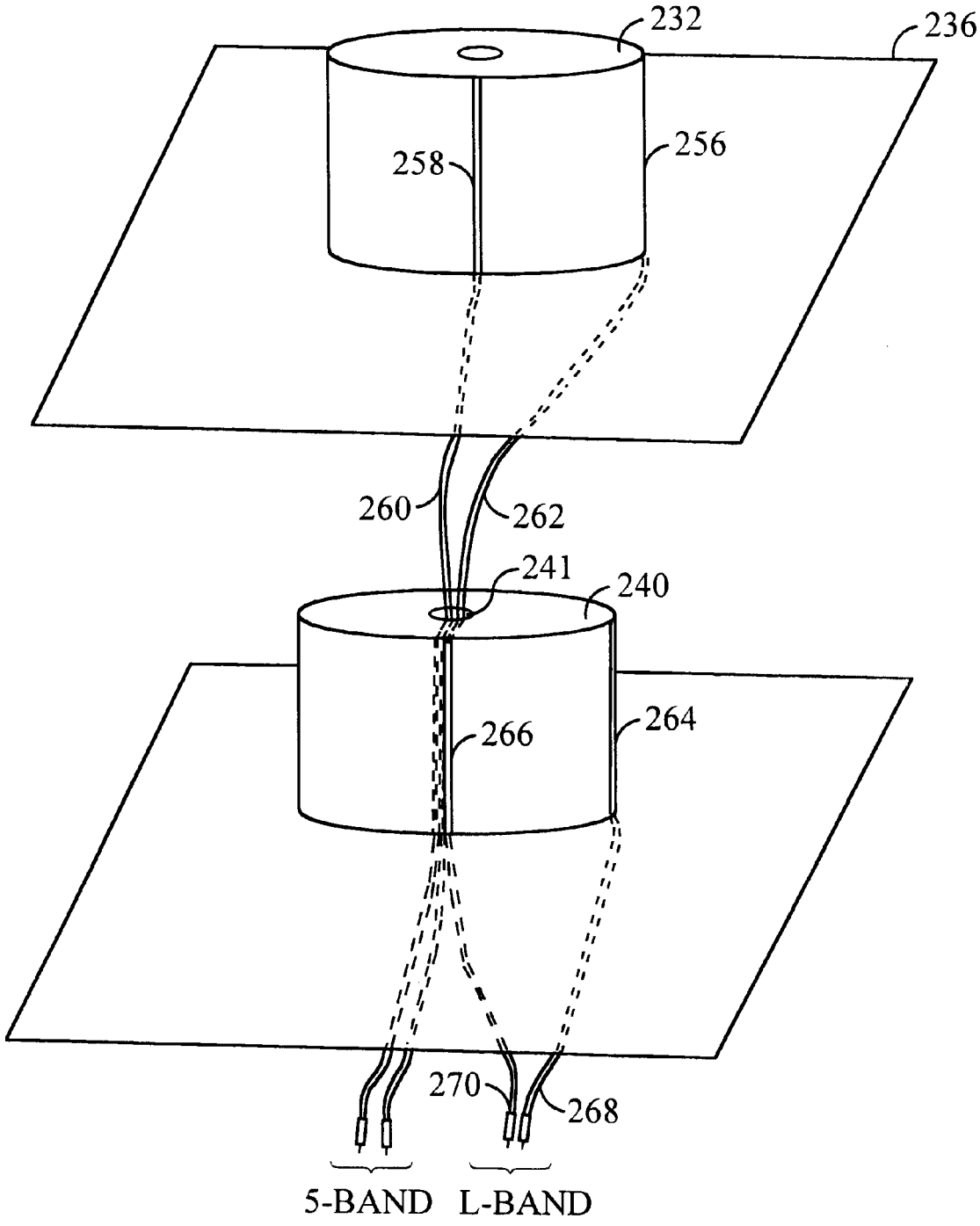
FIG. 2C shows the feed probe arrangement of the stacked antenna assembly of FIG. 2B

FIG. 2C shows the feed probe arrangement of the stacked antenna assembly of FIG. 2B in more detail. Upper resonator 232 is fed by feed probes 256 and 258. Conductors 260 and 262, which connect the feed probes to transmit/receive circuitry (not shown), extend through central opening 241 in lower resonator 240. Lower resonator 240 is fed by feed probes 264 and 266, which, in turn, are connected to the transmit/receive circuitry by conductors 268 and 270. In the exemplary embodiment shown, upper resonator 232 operates on the S-Band, while lower resonator 240 operates on the L-Band. It will be apparent to those skilled in the relevant art that these band designations are only exemplary. The resonators can operate on other bands. Additionally, the S-Band and L-Band resonators can be reversed, if desired.

An optimum gap spacing should be maintained between antennas 224 and 228 to reduce coupling between the antennas. As with the previously described embodiment, this optimum gap spacing is determined empirically. For example, it has been determined that for an S-band antenna and an L-band antenna configured vertically as illustrated in FIGS. 2B and 2C, the optimum gap 226 is on the order of 1 inch, that is, ground plane 236 should be separated from dielectric resonator 240 by about 1 inch.

The dielectric resonator antenna is suitable for use in satellite phones (fixed, portable, or mobile), including phones having antennas mounted on various structures or flat surfaces (for example, an antenna mounted on the roof or other surface of a car). These applications require that the antenna operate at a high gain at low elevation angles. Unfortunately, antennas in use today, such as patch antennas and quadrifilar helix antennas, do not exhibit high gain at low elevation angles. For example, patch antennas exhibit −5 dB gain at around 10 degrees elevation. In contrast, dielectric resonator antennas of the type to which this invention is directed exhibit −1.5 dB gain at around 10 degrees elevation, thereby making them attractive for use as low profile antennas in satellite phone systems.

Another noteworthy advantage of a dielectric resonator antenna is its ease of manufacture. A dielectric resonator antenna is easier to manufacture than either a quadrifilar helix antenna or a microstrip patch antenna, thus, reducing overall costs for wireless device manufacturing.

TABLE III

| | |
|---|---|
| Operating frequency | 1.62 GHz |
| Dielectric constant | 36 |
| ground plane dimension | (3 inches) × (3 inches) |

Figure 3:
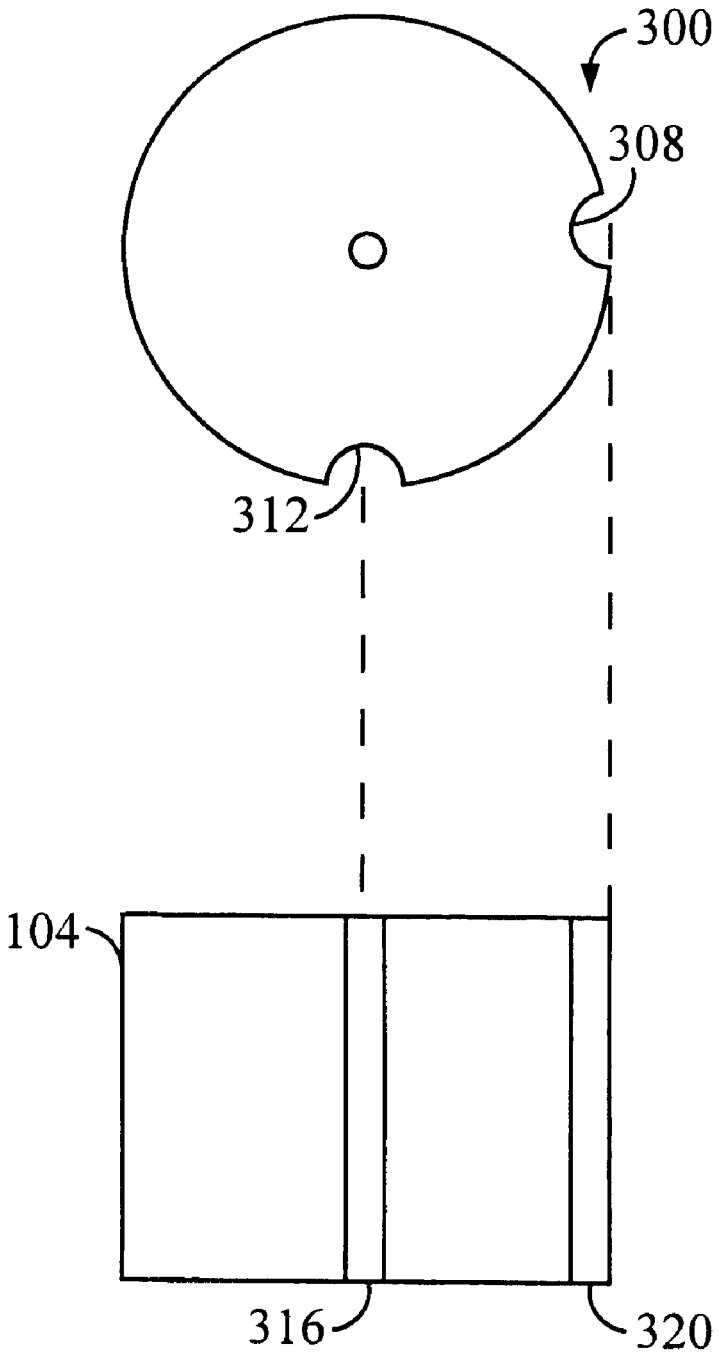
FIG. 3 illustrates a circular plate sized to be placed under a dielectric resonator.

FIG. 3 shows a conductive circular plate 300 sized to be placed between dielectric resonator 104 and ground plane 108. Circular plate 300 electrically connects dielectric resonator 104 to the ground plane. Circular plate 300 reduces the dimensions of any air gap between dielectric resonator 304 and ground plane 108, thereby inhibiting deterioration of the antenna's radiation pattern. Circular plate 300 includes two semi-circular slots 308 and 312 at its perimeter. Slots 308 and 312, however, can also have other shapes. Slots 308 and 312 are spaced apart from each other along a circumference by 90 degrees and are sized to receive appropriately shaped feed probes. Dielectric resonator 104 includes two notches 316 and 320 at its perimeter. Each notch is sized to receive a feed probe and is coincident with a slot of circular plate 300. Slots 316 and 320 can also be plated with conductive material to attach to the feed probes.

Figure 4A:
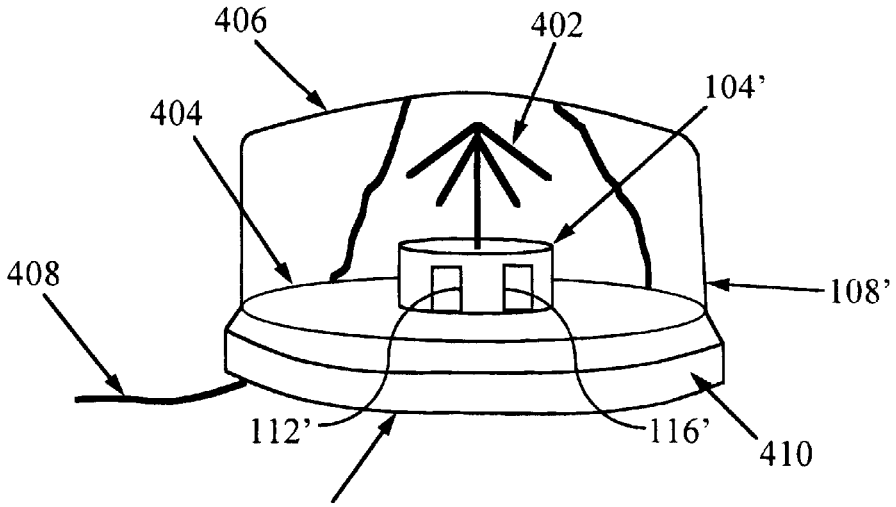
FIG. 4A illustrates another embodiment that incorporates a crossed dipole antenna with a dielectric resonator.

FIG. 4A shows an embodiment which incorporates a dielectric resonator antenna and a crossed dipole antenna. This embodiment integrates a dielectric resonator antenna 104' operating at satellite telephone communications systems uplink frequencies (L-band) with a bent crossed-dipole antenna 402 operating at satellite telephone communications systems downlink (S-band) frequencies. Dielectric resonator antenna 104' is mounted to a ground plane 108'. A conductively clad printed circuit board (PCB) 404 forms the top of ground plane 108' to which dielectric resonator antenna 104' is attached. On the other side of PCB 404 is a printed quadrature microwave circuit (not shown) whose outputs feed the orthogonally-placed conductive strips or feed probes 112' and 116' on the sides of the dielectric resonator antenna. Right angle conductive via holes from the feed outputs to the upper ground plane surface 404 carry the uniform amplitude but quadrature phased signals to the conductive strips. The strips (not shown) wrap around and continue part way across the bottom of the antenna 104', thereby providing for a novel and low cost way to attach the puck to the via hole islands by use of conventional wave soldering techniques. A low profile radome 406 covers both antennas. A cable 408 is connected to conductive strips 112' and 116' for carrying uplink/downlink RF signals and DC bias for the active electronics in the housing.

The entire antenna unit is mounted to a base member 410. Base 410 may advantageously be made of a magnetic material or have a magnetic surface for mounting the antenna unit to a car or truck roof.

Dielectric resonator antenna 104' is formed from a cylindrically shaped piece called a "puck" made of high dielectric (hi-K) ceramic material (that is, $\in_r$>45). The hi-K material allows for a reduction in the size required for resonance at L-band frequencies. The puck is excited in the ($HEM_{11}$.) mode by the two orthogonally-placed conductive strips 112' and 116'. This mode allows for hemispherically-shaped, circularly-polarized radiation. The diameter and shape of ground plane 108' can be adjusted to improve antenna coverage at near horizon angles.

The $HEM_{11}$. mode fields in and around the puck do not couple to structures placed along the axis of the puck. Thus, a single transmission line (coax or printed stripline) feeding the dipole pairs can protrude through the center of the Dielectric resonator antenna without adversely effecting the radiation pattern of the Dielectric resonator antenna. In addition, the dipole arms are not resonant at L-band frequencies so that L to S band coupling is minimized. The crossed-dipoles are placed at a distance of about ⅓ wavelength (1.7 inches at satellite downlink frequencies) above the ground plane 108'. Excited in this way, the dipoles produce hemispherical circularly polarized radiation patterns ideal for satellite communications applications. The height above the ground plane and angle at which the dipole arms are bent can be adjusted to give different radiation pattern shapes which emphasize reception at lower elevation angles instead of at zenith. The effect of the presence of the puck below the dipoles can be also be accommodated in this fashion.

Figure 4B:
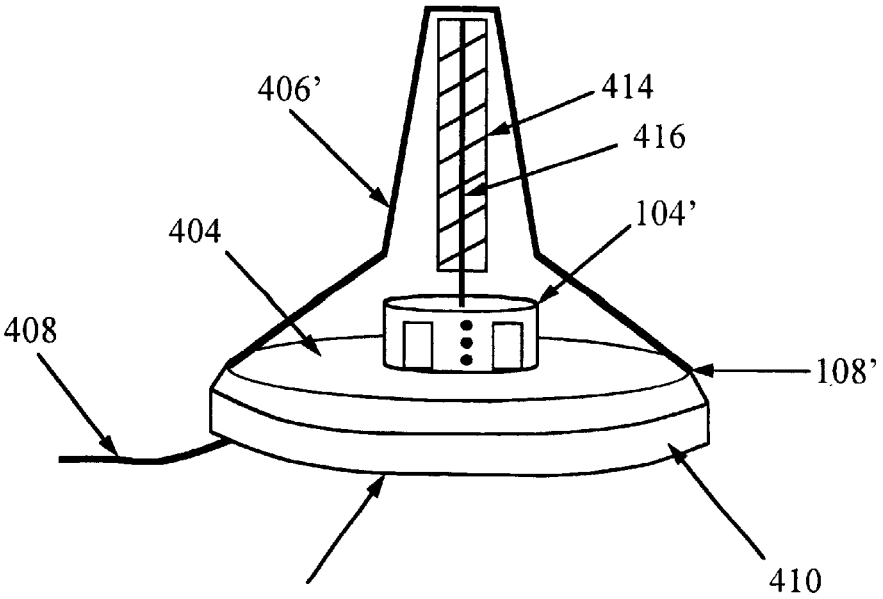
FIG. 4B illustrates a further embodiment that incorporates a quadrifilar helix and a monopole whip with the dielectric resonator antenna.

In a variation of the embodiment of FIG. 4, the crossed dipole antenna can be replaced by a quadrifilar helix antenna (QFHA). The QFHA is a printed antenna wrapped around in a cylinder shape. The diameter can be made small(<0.5'). The antenna can be suspended above the dielectric resonator antenna using a plastic stalk with the stalk and QFHA axis coincident with the dielectric resonator antenna axis. The radiation pattern of the QFHA has a null In a still further variation shown in FIG. 4B, a quadrifilar helix antenna 414 is mounted with its central axis coincident with the central axis of dielectric resonator antenna 104'. A ¼ wavelength whip antenna 416 is installed along the common axis of QFHA 414 and dielectric resonator antenna 104'. Since dielectric resonator antenna 104' and QFHA 414 have null fields along their axis, coupling to whip 416 is minimized. This whip can be used for communication in the 800 Mhz cellular band.

Figure 5:
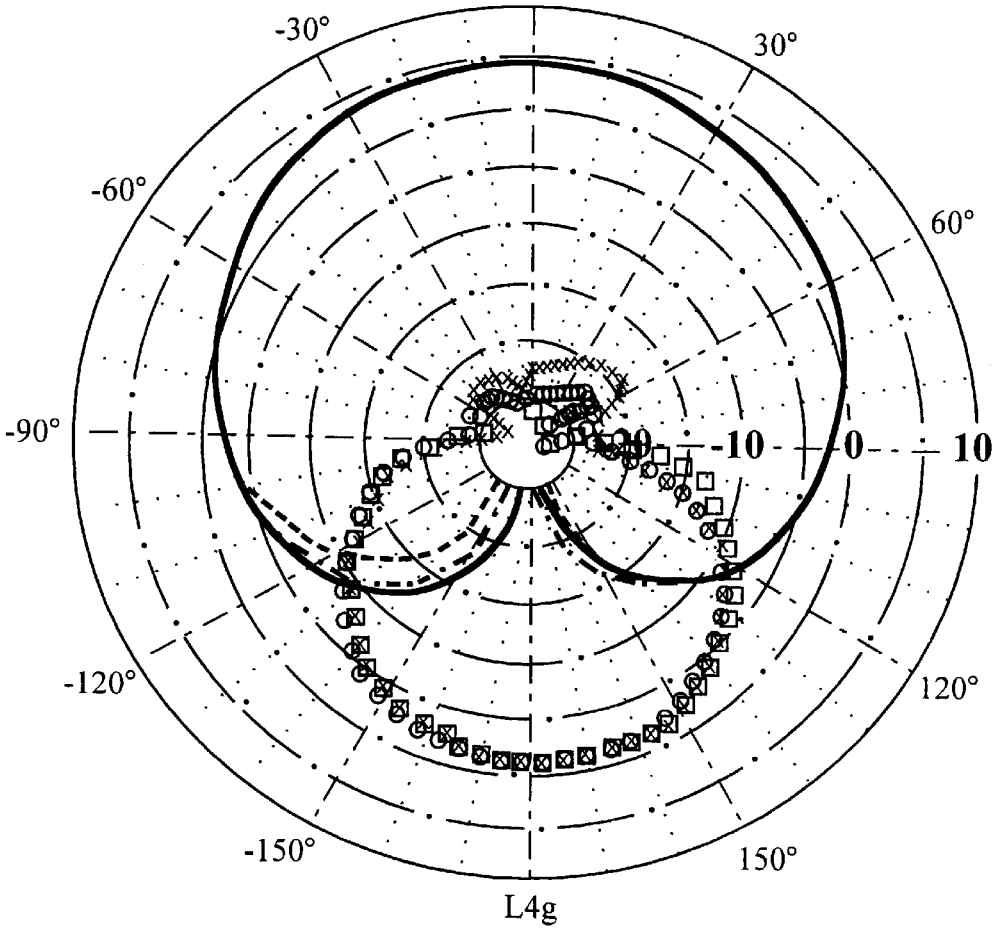
FIG. 5 illustrates a computer simulated antenna directivity vs. elevation angle plot of a dielectric resonator antenna constructed according to the invention and operating at 1.62 GHz.
Figure 5:
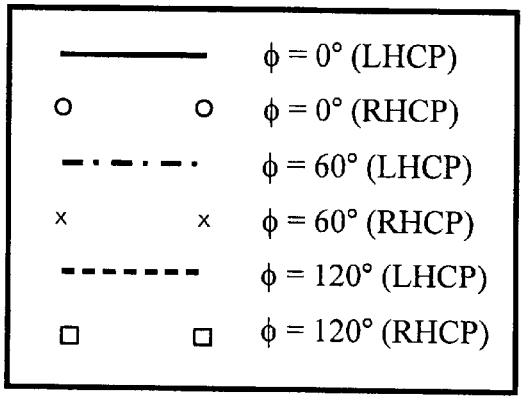

FIG. 5 illustrates a computer simulated antenna directivity vs. elevation angle plot of a dielectric resonator antenna constructed according to the invention and operating at 1.62 GHz. The dielectric constant $\in_r$ of the resonator is selected to be 45 and the ground plane has a diameter of 3.4 inches. Although, in this simulation, the ground plane was chosen to have a circular shape, other shapes can also be chosen. The simulation results indicate that the maximum gain is 5.55 dB, the average gain is 2.75 dB and the minimum gain is −1.27 dB for elevations above 10 degrees.

Figure 6:
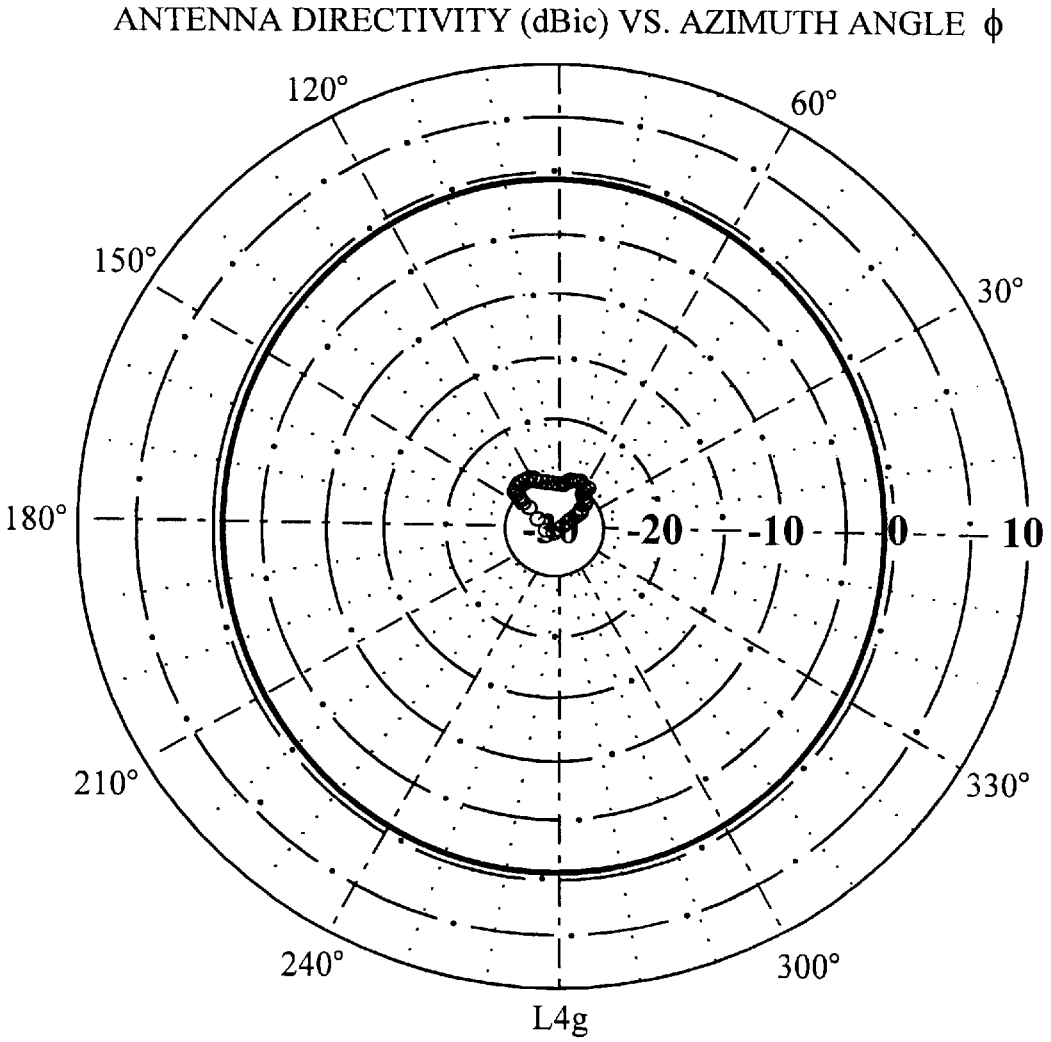
FIG. 6 illustrates a computer simulated antenna directivity vs. azimuth angle plot of the same antenna operating at 1.62 GHz.
Figure 6:
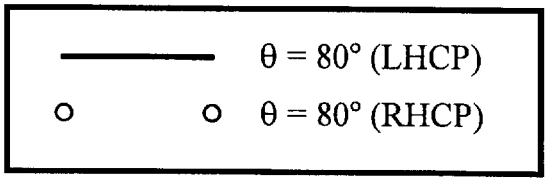

FIG. 6 illustrates a computer simulated antenna directivity vs. azimuth angle plot of the same antenna at 10 degree elevation operating at 1.62 GHz. The simulation results indicate that the maximum gain is −0.92 dB, the average gain is −1.14 dB and the minimum gain is −1.50 dB at 10 degree elevation. Note that the cross-polarization (RHCP; or Right Hand Circular Polarization) is extremely low (less than −20 dB). This indicates that the dielectric resonator antenna has an excellent axial ratio even near the horizon.

III. Single Feed DRA

It has also been discovered that shaping the dielectric resonator material in an appropriate fashion, non-circular with an offset axis feed point, or using a slot or other physical element, the modes desired for a polarized antenna can be separated. Therefore, a single electrical feed element can be used on such structures to achieve the desired polarization modes. The present invention recognizes that such single feed elements may be provided and is not limited to the two feed structure being described for purposes of clarity in illustration.

IV. Preferred Embodiments of The Invention

The stacked design discussed above is an improvement over the art, providing: a low profile, small-size antenna for satellite communication applications; with simplified attachment to a PCB feed and for mounting of elements such as a transmit power amplifier at the antenna port, which minimizes losses and improves efficiency. This arrangement allows for integration of other antenna types along the dielectric resonator antenna axis, thereby allowing for multifunction, multi-band performance in a single low profile assembly. However, even though this allows a more compact reproducible and manufacturable antenna designs, whether dual or single feed structures are used, there still exists at least one drawback with the radiation patterns generated, or more correctly the antenna directivity.

Figure 7:
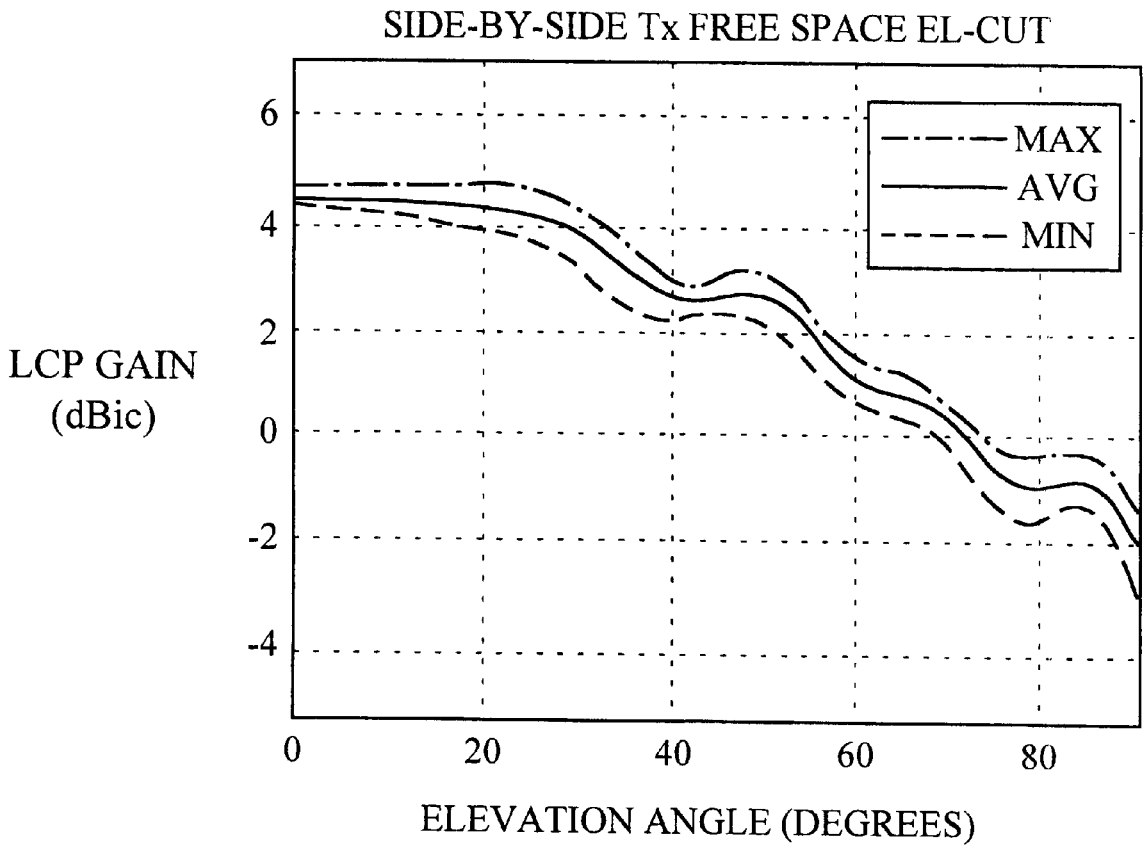
FIG. 7 illustrates a graphical representation of gain versus elevation for a typical dielectric resonator antenna.

For example, as can be clearly seen from FIG. 5 and again in FIG. 7, the directivity or gain for a typical DRA element, and an antenna assembly using such an element, decreases rapidly at lower elevation angles. Here we define elevation as the angle above the ground plane of the antenna which generally coincides with a local horizon for the antenna. This is shown in FIG. 7 where the gain is clearly at a maximum at the maximum elevation angle (90 degrees) and very low at the lower elevations (less than 20 degrees), especially lower around 10 degrees. Alternatively, one can look at this relative to the 'z' or central axis of the DRA and have an elevation of 0 degrees as the maximum and an elevation of 80–90 degrees as the minimum.

This drop off in gain results in the radiation pattern, as seen in FIG. 5, being primarily directed upward with a decreasing gain or directivity toward the side or parallel to the ground plane (which is generally parallel to the horizon) of the antenna. If the antenna gain is rapidly decreasing toward the lower elevations, then the signal transfer characteristics (mostly for receiving signals) will undergo sever degradation near the edges. For communication systems employing Low or Medium Earth Orbit (LEO or MEO) satellites, or certain types of terrestrial base stations, the signal sources will often fall within these lower elevations, which can result in an unacceptable decrease in performance.

For example, it may be desirable to establish a communication link through a satellite at a lower elevation and continue that link while the satellite moves in orbit to a higher elevation relative to the user, and then maybe as it moves back to a lower relative elevation. Some satellite system users are positioned at higher attitudes where satellites may never reach an overhead relative position, and may be in view at lower elevations much of the time, depending on the design of the satellite constellation. This is not as much a problem at lower attitudes, but it could still be necessary in some situations to select or switch communications to a lower elevation satellite. In these situations, large changes in gain are undesirable as being harder to compensate for or manage while trying to maintain a high quality communication link.

In addition, there is a desire to use minimal signal power either in the satellite, or base station, or for signals being transmitted by the user terminal to maintain a communication link, so each part of the system desires to have as much gain as practical. Increasing power to compensate for lower gain results in increased intra-user and intra-communication system interference, and an undesirable increase in power consumption from limited power resources, such as terminal or satellite batteries. Being able to compensate for lower gain may also require the use of more expensive components for higher levels of amplification, increased sensitivity to low power signals, and so forth. All of these effects can add to the cost and complication of a communication system. Applicants have discovered that a new structure and technique can be used in combination with the DRA ground plane to tailor the antenna radiation patterns, and thus the elevational directivity or gain of the antenna to achieve better edge or low angle performance. This new technique achieves improved gains in multiple "stacked" configurations as well as for a single element, making multiple frequency satellite antenna structures more efficient, and lower profile. This is accomplished in a low cost highly efficient structure that is very amenable to low cost manufacturing and automated assembly processes.

The new radiation directivity is achieved through the creation of field or radiation pattern adjustment "skirts" or shields on the antenna assembly as part of, or adjacent to and electrically coupled to, the ground plane of a given dielectric resonator assembly for which the radiation is being tailored. The skirts can be adjusted in size (height) and angular displacement from the ground plane to achieve a desired level of impact on the lower elevation directivity/gain.

Figure 8:
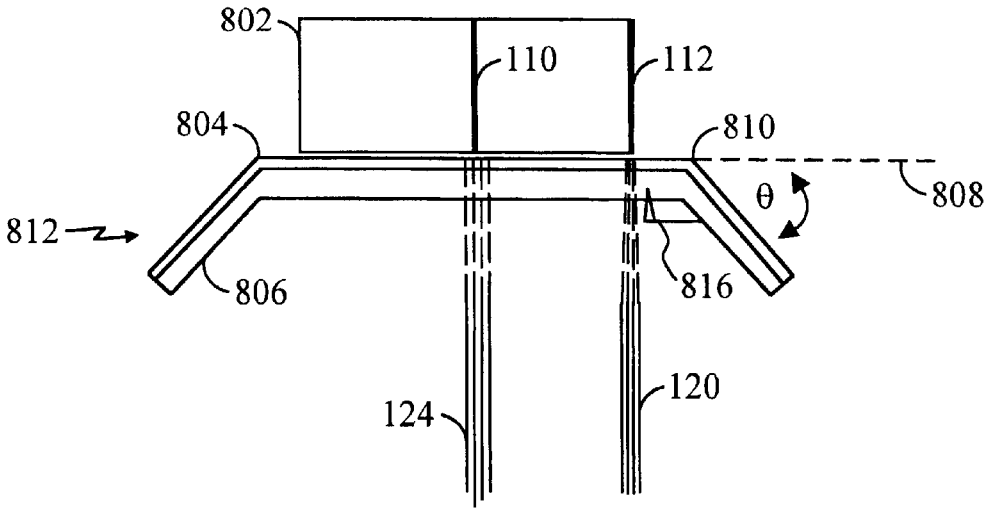
FIG. 8 illustrates a side view of an adjustment skirt with a single cylindrical dielectric resonator.
Figure 9:
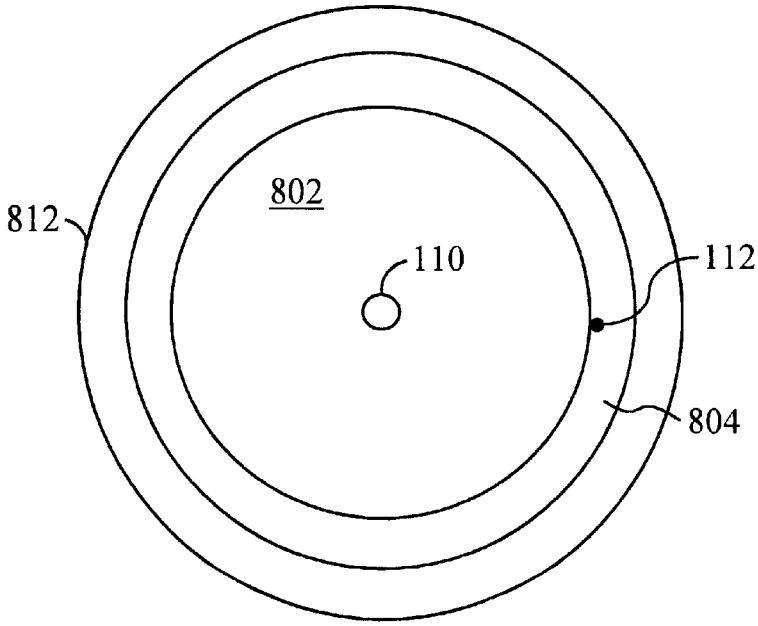
FIG. 9 illustrates a top view of the adjustment skirt and resonator of FIG. 8.

The use of an adjustment skirt with a single cylindrical dielectric resonator is illustrated in a side view in FIG. 8, and in a top view in FIG. 9. In FIGS. 8 and 9, a cylindrical, or other desired shape, dielectric resonator element 802 is disposed on a ground plane 804 as previously discussed above using known techniques. The ground plane in this configuration is circular to match the shape of dielectric resonator 802, although this is not necessary, as would be known. Ground plane 804 is disposed on a support substrate 806. As desired, various discrete components and known elements or devices such as low noise amplifiers can be mounted on the side opposite the ground plane to provide low loss interconnections to the dielectric resonator and improve signal transfer performance.

In this latter case, the substrate is typically manufactured in the form of a multi-layered printed circuit board (PCB) type of structure having a conductive material deposited on one surface to form the ground plane. Various patterned electrical conductors are deposited, etched, or otherwise formed thereon and therein (intermediate layers) using well known circuit board techniques, for transferring signals and interconnecting components to be used with the antenna.

The dielectric resonator electrical fields interact with the ground plane to extend upward and somewhat outward as generally shown in FIG. 6. This line is a general representation of the process and not a specifically detailed or accurate position of the fields. Applicants have discovered that by extending the ground plane at a downward angle from the previous or typically existing edge 810, that the field can be made to interact with an extended size ground plane, so that it projects outward in a lateral direction but altered to extend farther downward toward the horizon. That is, due to the downward slant of the ground plane element 812, the field is also "directed" or moved downward, thus, elongating the lines and bending them closer to the plane of the previous ground plane, as seen by the projecting dotted line from the previous plane.

The new ground plane angular, sloped, or curved surface or skirt can be implemented using several techniques and materials, For example, this projection can be achieved by extending and shaping the underlying substrate or PCB 806 in some circumstances depending on the material being used. However, where more traditional PCB materials are used as opposed to thinner plastics and the like, those materials are not very flexible, deformable, or "bendable," and it is not generally possible to construct the angular portion without creating another support substrate.

Therefore, a thin sheet of metallic or conductive material, such as an electrically conductive composite, can be manufactured thick enough to hold its own weight and extend at the desired angle. The material can actually be fairly thick in some applications such as where a stamped or extruded aluminum, stainless steel, titanium, or copper plate or foils is used. The bottom edge or edges of the skirt can be rolled, folded, or crimped for better rigidity, however a straight edge may be preferred. A variety of well known metallic material could be used for this application subject to the well understood electrical properties of the material and those being sought in the skirt design. This would result in a frustrated conical shaped part, or one having other geometrical shapes to match the ground plane edges.

Alternatively, the conductive material can be deposited, sprayed, painted, or otherwise formed on the outer, inner, or both surfaces of a frustrated conical support element. Such an element can be easily formed out of a variety of plastics, resinous, or other dielectric materials, the specific material being chosen based on known factors such as cost, manufacturability, and ease of installation.

The angled conductive surface(s) must be electrically connected to the ground plane at at least one point, but preferably has multiple connections or a continuous connection to provide a reasonably high level of certainty that the field lines see a continuous angled grounded surface to interact with. If significant portions of the surface have a charge level significantly different than ground, this could effect how much and in what manner the field lines, and, thus, the desired gain pattern are redirected into the lower elevation angles. These electrical contacts can be made in several known ways such as using wires or conductive tabs soldered to the surfaces, conductive tape pressed on the surfaces, or conductive caulking, rubber, glue or other liquid material that becomes more solid after deposition.

The support substrate for the skirt can be secured in place using several known elements or techniques. For example, it can attached by adhesives, potting compounds, rubber molding, glue or a series of fasteners such as, but not limited to, small screws or rivets to the ground plane support substrate. It can have a lip, or ledge 816 formed around its upper periphery to facilitate alignment and securing in place, such as providing material for better support and screws. It can have as series of simple tabs or projections that interact with matching elements mounted on support substrate 806. Alternatively, support substrate 806 can be mounted on another or adjacent structure which holds it in place next to the ground plane, to which it is connected.

Figure 10:
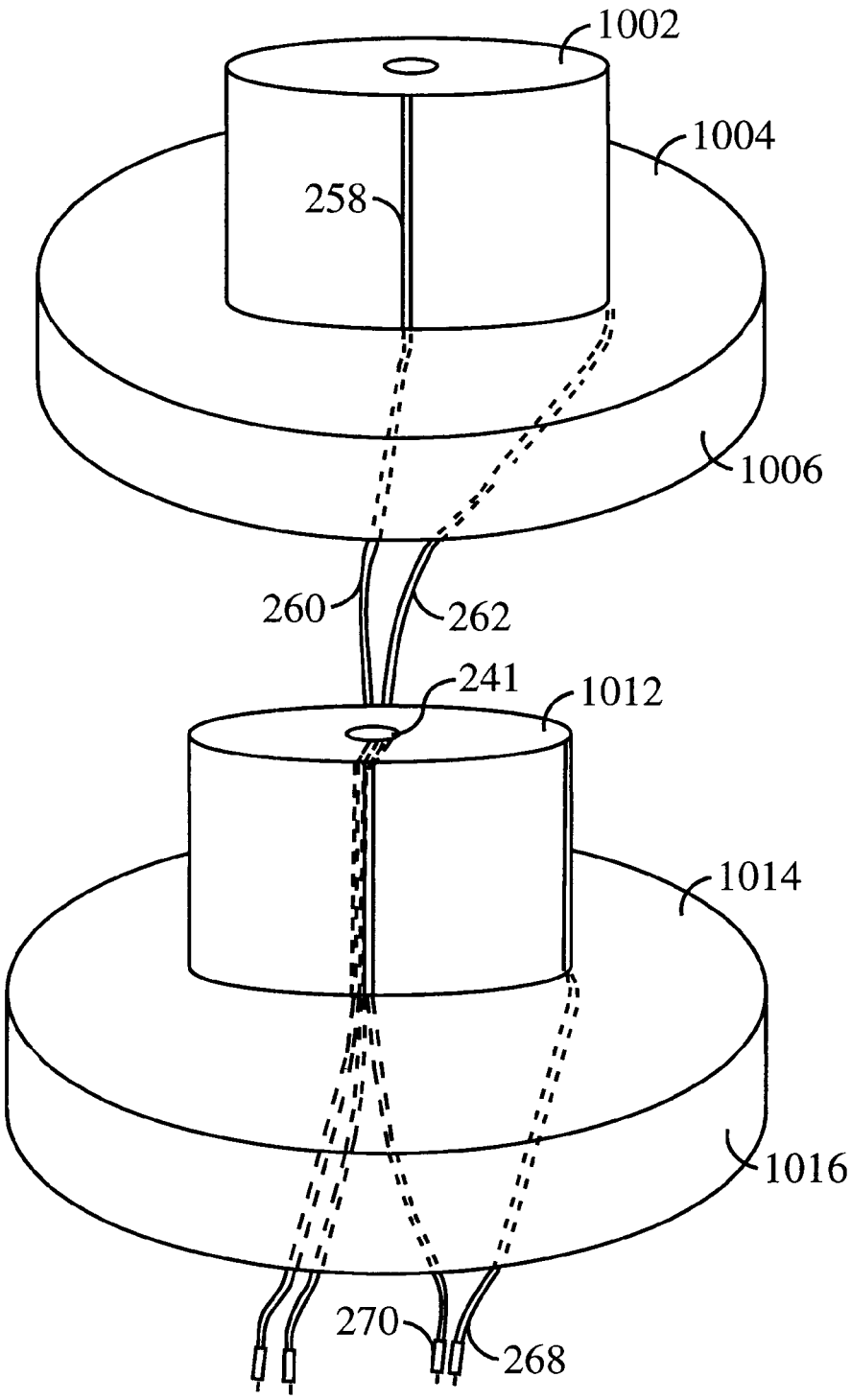
FIG. 10 illustrates a side view of a stacked antenna assembly of FIG. 8.

One can see how this technique can also be applied advantageously to the stacked configuration discussed earlier. This is illustrated in FIG. 10 where two dielectric resonator elements 1002 and 1012 are shown mounted on each of two ground planes 1004 and 1014, respectively. Here, two skirts 1006 and 1016 are used, typically of differing sizes, since the antennas are generally different sizes to address different frequency bands. Each skirt is mounted on one corresponding ground plane 1004 and 1014 respectively. The larger the dielectric resonator element, the larger the diameter or peripheral size of the ground plane. Therefore, a larger skirt is to be applied. Note that there is no strict requirement for the skirt to be conical just angled. Therefore, a square, octagonal, or variable or meandering shaped edge for the ground plane can have a similarly shaped skirt to match. The shape is not limited by the present invention, but is generally based on appropriate characteristics to provide a smooth transition for the fields being accommodated by the dielectric resonator. Therefore, the edges are typically not very dynamic or dramatic in terms of shape changes.

The two ground planes are spaced apart a distance that provides for the desired radiation pattern or gain. This is generally found using simulations and empirical data In the preferred embodiment at the frequencies of interest, this spacing was found to be on the order of 0–0.75 inches. It should also be understood that the ground plane is generally designed to have a certain size, and the angled portions fall within that overall size, therefore, since they are sloped downward, the overall footprint of each antenna is smaller than typically encountered which is very advantageous.

Placement of the ground adjustment skirts on dielectric resonator elements that are in a stacked configuration, may seem counter intuitive at first. One may incorrectly think that the shields or skirt will cause too much interference with the characteristics of the lower antenna. However, it is the far field radiation and characteristics that one is interested in, and not the near field. In the far field view, the field lines 'escape' or pass between the gaps in the skirts and ground planes to establish the overall gain or directivity pattern desired. In addition, when using dielectric resonators in this configuration, the upper and lower antennas are effectively decoupled from each other, and the upper antenna in the stack does not negatively impact the gain or other characteristics.

However, there is still an issue with how such an assembly is assembled or the upper antenna elements are supported. That is, it is still important to avoid having conductive surfaces or objects positioned between the two antennas unless necessary, to prevent interference with the radiation or scattering. While very thin posts and insulated materials can be used, the most useful structure appears to be the cylindrical or post support placed near the middle for the central axis. However, for purposes of rigidity, robustness, accommodating vibration and even temperature shifts and movement, this may be less than desirable. Therefore, the applicants have devised a new antenna structure to take full advantage of the new gain adjustment structure, while providing the physical attributes desired to also produce a smaller more efficient and economical antenna design.

In a typical stacked arrangement, as shown earlier, a radome is used to protect the antenna elements, protect components mounted on substrates, and provide improved aerodynamics. Such radomes are well known in the industry and are generally manufactured from a fairly thin lightweight electrically non-conductive material such as a polycarbonate material. The radome extends over the complete assembly and is secured to a base plate or similar support element which in turn is often used for securing the antenna in place on a surface, such as the exterior of a vehicle or building, either through fasteners (such as bolts) or even magnetic elements or clips. What applicants have discovered is that when skirt elements are used inside a radome structure, the radome itself can be made to efficiently support or form the skirt.

One technique for providing this support is to simply form the radome with tabs, projections, a lip, or ridge extending from an inner surface adjacent to where the bottom edge of the skirt should be located. In this arrangement, the skirt can be at least partially supported by such extensions or projections. Since the skirt needs to fit farther up into a narrower portion of the radome and yet clear the projections, the skirt might use slots or passages for initially clearing them. For example, the skirt might be inserted past the projections, and then be rotated to rest on them.

Alternatively, it is also possible to form the skirt with a reasonably wide lip on the bottom (or top) edge through which fasteners are inserted into any projecting surfaces, or into a reinforced or thicker portion of the radome. In addition, adhesives, screen printed materials, and the like can be used in known combinations to provide bonding to the inner surface of the radome, or to projections.

A preferred technique, however, is to manufacture the skirt as part of the radome itself. That is, to plate, coat, paint, or otherwise deposit conductive material on an inner surface of the radome in a desired location to form a skirt structure. This would also assure no variations in interaction with fields due to unexpected air-gaps between the edge of the angular portion of the ground plane and the radome. In this scenario, the material is deposited in place and then the remaining inner ground plane is brought into contact with an edge or contact surface when mounted in place. In the alternative, or in addition, some type of electrical connection bridging the gap, such as wires, conductive tape, or a conductive sealant can be used to make an electrical connection.

Figure 11:
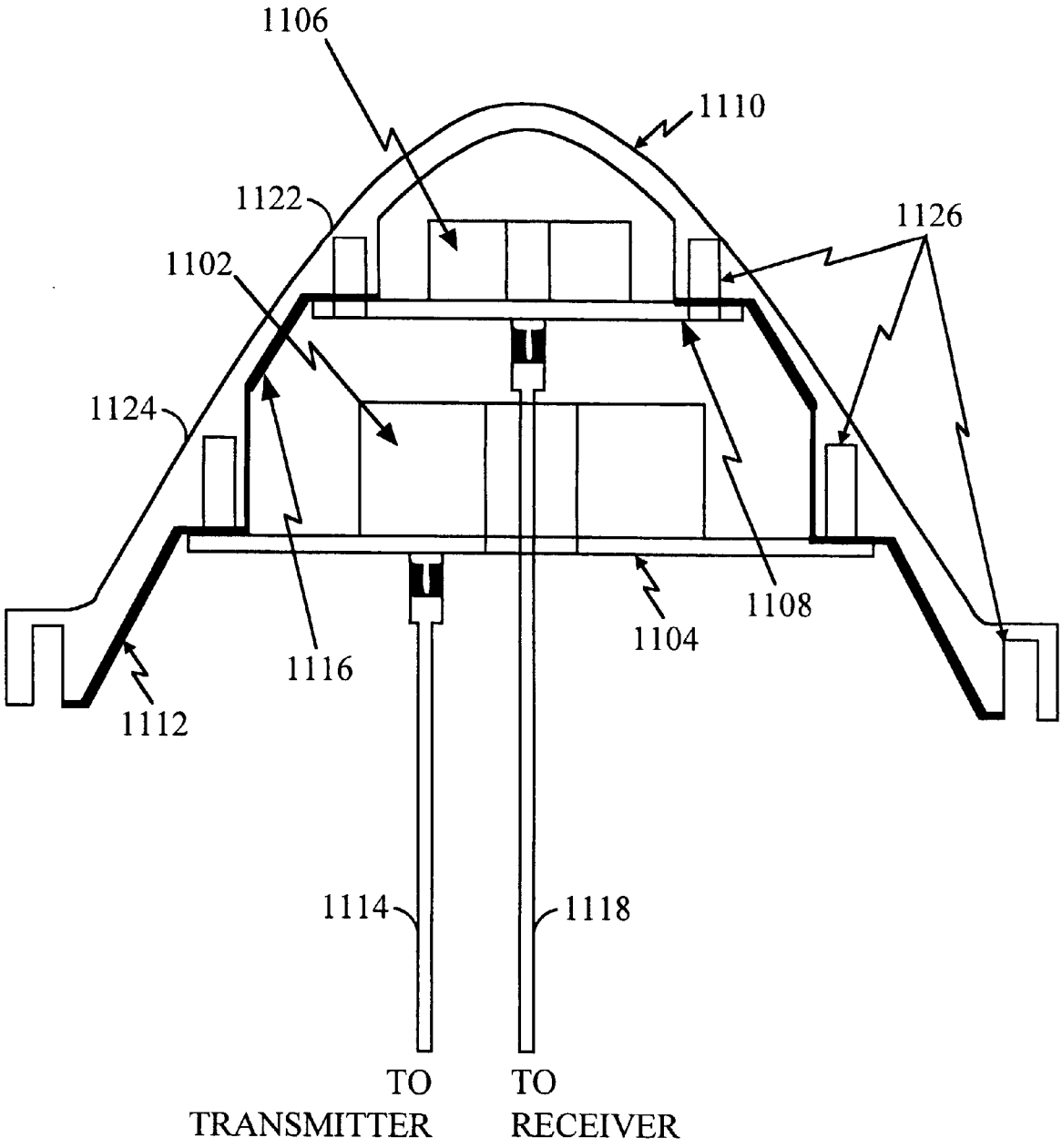
FIG. 11 illustrates a side view of a stacked antenna assembly mounted within a radome using inventive conductive skirts formed on an inside surface thereof.

A preferred embodiment that was used to construct and test the present invention is illustrated in the side view of FIG. 11. In FIGS. 11, a stacked DRA assembly 1100 is shown having a first or lower dielectric resonator element 1102, positioned on a first or lower ground plane substrate 1104, and a second or upper dielectric resonator element 1106, positioned on a second or upper ground plane substrate 1108. The entire assembly is covered by a radome 1110, on the interior of which is formed a lower skirt 1112 and an upper skirt 1116. The dielectric resonators are coupled to antenna signal receivers or transmitters through lower antenna cable 1114 and upper antenna cable 1118, respectively. The function of these antennas was selected to be using the upper antenna as a receiving antenna and the lower antenna as a transmitting antenna because the frequencies of interest were such that the upper antenna would be smaller than the lower one. However, it will be clear to those skilled in the art that the functions of the antennas may be reversed, or they may both e used for the same function but at different frequencies, and so forth, without impacting the present invention.

The radome has a two ridges, rims, or crests positioned adjacent to where the ground panes are to be mounted within radome 1110. As discussed above, a continuous ridge or rim around the circumference, or periphery for non circular shapes, of the radome can be used, or a series of projections or reinforced (thicker) locations can be used instead, as would be known. In the illustrated embodiment, upper rim 1122 is placed where the upper surface of ground plane substrate 1104 is desired to be located after assembly, and lower rim 1124 where the upper surface of ground plane substrate 1108 is desired to be located after assembly.

A series of screw holes 1126 are formed at various, generally even spaced, locations around each rim for receiving screws through holes in the substrates to secure them in place. Typically, screws, or bolts where the passages are threaded, made from a plastic or other non-conductive material are used to minimize signal interaction or interference.

Figure 12:
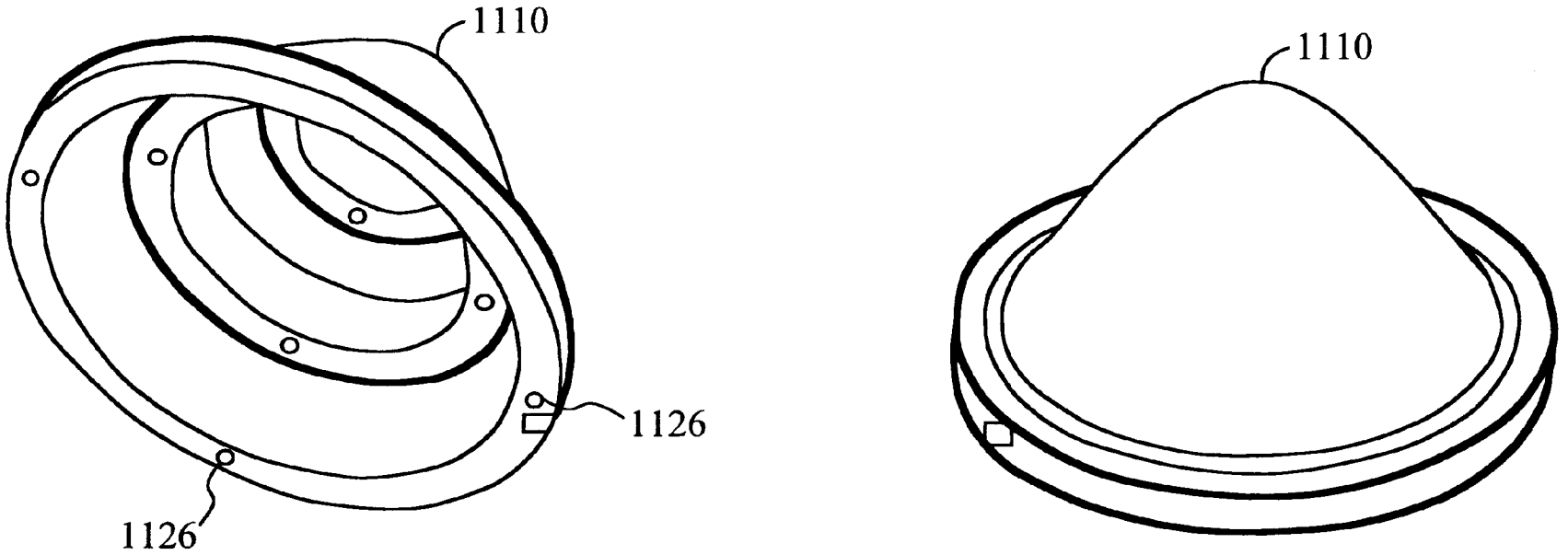
FIG. 12 illustrates perspective views an exemplary radome for use in the stacked assembly of FIG. 11.

The radome element illustrated in the side view of FIG. 11 is also illustrated in bottom and top perspective views in FIGS. 12A and 12B, respectively.

It was found that not only does the above antenna structure provide a smaller footprint for a given antenna due to the downward slope of the outer portion of the ground plane, but that the gain at lower elevations is increased on the order of 1–2 dB.

V. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What we claim as the invention is:

1. An adjusted directivity dielectric resonator antenna, comprising:

a dielectric resonator formed from a dielectric material; and a ground plane formed of a conductive material supporting said dielectric resonator, said ground plane having a portion positioned adjacent to a periphery of said dielectric material; and a conductive shirt positioned adjacent to and electrically coupled to said ground plane.

2. The antenna according to claim 1, wherein said dielectric resonator is shaped as a right cylinder, said ground plane is substantially flat over a central portion and has an outer circumference that is angled downward at an obtuse angle relative to said flat central portion to form said skirt.

3. The antenna according to claim 1, wherein said dielectric resonator is shaped as a right cylinder, said ground plane is substantially flat over a central portion and has an outer circumference that is curved downward in an elliptical arch relative to said flat central portion to form said skirt.

4. The antenna according to claim 1, further comprising at least one signal probe electrically coupled to said resonator to transfer signals to and from said resonator, and produce circularly polarized radiation in said antenna.

5. The antenna according to claim 4, wherein said probe is substantially orthogonal to said ground plane.

6. The antenna according to claim 1, wherein said resonator is formed of a ceramic material.

7. The antenna according to claim 1, wherein said resonator is formed of a ceramic having a dielectric constant $\in_r$ greater than 10.

8. The antenna according to claim 7, wherein the dielectric constant $\in_r$ of said ceramic material is greater than 45.

9. The antenna according to claim 7, wherein the dielectric constant of said ceramic material is greater than 100.

10. The antenna according to claim 1, further comprising a second dielectric resonator positioned on said ground plane.

11. The antenna according to claim 1, wherein said ground plane further comprises a support substrate and a layer of conductive material deposited on said substrate.

12. The antenna according to claim 11, wherein said substrate comprises a multi-layered circuit board.

13. A dual band dielectric resonator antenna, comprising:

a first resonator formed of a dielectric material;

a first ground plane formed of a conductive material on which said first resonator is mounted, being shaped to have an angular portion extending downward from a lower surface of said dielectric material;

a second resonator formed of a dielectric material; and a second ground plane formed of a conductive material on which said second resonator is mounted, said first and second ground planes being separated from each other by a predetermined distance.

14. The antenna according to claim 13, wherein said resonators are substantially rectangular in cross section.

15. The antenna according to claim 13, wherein said resonators are substantially elliptical in cross section.

16. The antenna according to claim 13, wherein said resonators are substantially octagonal.

17. The dual band antenna according to claim 13, further comprising first and second probes electrically coupled to each of said resonators spaced approximately 90 degrees apart around the perimeter of each resonator providing first and second signals, respectively, to each resonator, wherein each of said resonators resonates in a predetermined frequency band that differs between said resonators.

18. The dual band antenna according to claim 13, further comprising support members for mounting said first and second ground planes in spaced apart relation with a predetermined separation distance such that the central axes of said resonators are substantially aligned with each other.

19. The dual band antenna according to claim 13, further comprising a radome positioned to enclose at least an upper portion of both of said resonators.

20. The dual band antenna according to claim 19, wherein said first and second ground planes are attached to an inner wall of said radome so that downward portions project along said inner wall.

21. The dual band antenna according to claim 19, wherein downward portions of said first and second ground planes comprise electrically conducting material disposed on said inner surface of said radome, and said ground planes further comprise a central portion attached to an inner wall of said radome adjacent said conducting material so as to make electrical contact therewith and form a complete ground plane.

22. Apparatus for adjusting the directivity of a dielectric resonator antenna which has a central axis and is formed from dielectric material having a surface resting on or adjacent to a ground plane, comprising:

an electrically conductive material configured as a skirt adjacent to an outer periphery of said antenna, and electrically coupled to said ground plane.

23. The apparatus according to claim 22 wherein said skirt has a first edge forming a narrower portion positioned adjacent to said surface of said dielectric material resting on said ground plane and one or more conductive surfaces which extend from said first edge away from said surface and said dielectric material toward a second edge forming a wider portion positioned away from said surface.

24. The apparatus according to claim 23 wherein said skirt comprises electrically conducting material having a frusta-conical shape.

25. The apparatus according to claim 24 wherein said electrically conducting material forms a curvilinear planar surface.

26. The apparatus according to claim 24 wherein said electrically conducting material forms a multi-segmented planar surface.

27. The apparatus according to claim 24 wherein said electrically conducting material extends away from said dielectric material along said axis and offset from said axis at a generally uniform pre-selected angle less than 90 degrees to said axis.

28. The apparatus according to claim 24 wherein said electrically conducting material extends away from said dielectric material along said axis and offset from said axis at pre-selected multiple angles along its peripheral length which are less than 90 degrees to said axis.

29. The apparatus according to claim 24 wherein said electrically conducting material extends away from said dielectric material along said axis at multiple angles along its height.

30. The apparatus according to claim 22 wherein said skirt is physically attached to said ground plane by electrical conductors.

31. The apparatus according to claim 22 wherein said skirt is physically formed as part of said ground plane.

32. The apparatus according to claim 23 wherein said electrically conducting material forms a hemispherical planar surface.

33. The apparatus according to claim 22, further comprising a radome positioned to enclose at least an upper portion of said antenna and skirt.

34. The apparatus according to claim 33, wherein said skirt is attached to an inner wall of said radome to project downward along said inner wall.

35. The apparatus according to claim 34, wherein said skirt comprises:

electrically conducting material disposed on said inner surface of said radome; and a central portion of said ground plane attached to an inner wall of said radome adjacent said conducting material so as to make electrical contact therewith and form a complete ground plane.

36. The apparatus according to claim 22, wherein said electrically conductive material comprises a substantially non-conductive material coated on at least one side with metallic material.

37. A method for adjusting the directivity of a dielectric resonator antenna which has a central axis and is formed from dielectric material having a surface resting on or adjacent to a ground plane, comprising:

positioning an electrically conductive material configured as a skirt adjacent to an outer periphery of said antenna, and electrically coupled to said ground plane; and extending said skirt along a direction generally parallel to said vertical axis and away from a surface of said dielectric resonator offset from said axis by a pre-selected angle less than 90 degrees.

38. The method according to claim 37 further comprising forming said skirt with a first edge forming a narrower portion positioned adjacent to said surface of said dielectric material resting on said ground plane and forming one or more conductive surfaces to extend from said first edge away from said surface and said dielectric material toward a second edge forming a wider portion positioned away from said surface.

39. The method according to claim 37 comprising forming said skirt with a frusta-conical shape.

40. The method according to claim 39 comprising forming said skirt with a curvilinear planar surface.

41. The method according to claim 39 comprising forming said skirt with a multi-segmented planar surface.

42. The method according to claim 39 comprising forming said skirt to extend away from said dielectric material along said axis along its peripheral length at a generally uniform angle.

43. The method according to claim 39 comprising forming said skirt to extend away from said dielectric material along said axis at multiple angles along its peripheral length which are less than 90 degrees to said axis.

44. The method according to claim 39 comprising forming said skirt to extend away from said dielectric material along said axis at multiple angles along its height.

45. The method according to claim 37 comprising attaching said skirt physically attached to said ground plane by electrical conductors.

46. The method according to claim 37 comprising forming said skirt as a physical extension of said ground plane.

47. The method according to claim 37 comprising forming said skirt with a hemispherical shape.

48. The method according to claim 37, further comprising attaching said skirt to an inner wall of a radome positioned to enclose at least an upper portion of said antenna and skirt to project downward along said inner wall.

49. The method according to claim 48, comprising:

forming said skirt by disposing electrically conducting material on said inner surface of said radome; and forming a ground plane central portion attached to an inner wall of said radome adjacent said conducting material so as to make electrical contact therewith and form a complete ground plane.

50. The method according to claim 37, further comprising forming said electrically conductive material as metallic coating on a substantially non-conductive material.

* * * * *